US011857865B2

(12) United States Patent
Cortesi et al.

(10) Patent No.: US 11,857,865 B2
(45) Date of Patent: Jan. 2, 2024

(54) PORTABLE MULTI-USE BALL PIT

(71) Applicant: B1 & C1, INC., Wheaton, IL (US)

(72) Inventors: Joseph R. Cortesi, Wheaton, IL (US); Christopher L. Bogosian, Naperville, IL (US)

(73) Assignee: B1 & C1, Inc., Wheaton, IL (US)

( * ) Notice: Subject to any disclaimer, the term of this patent is extended or adjusted under 35 U.S.C. 154(b) by 74 days.

(21) Appl. No.: 17/378,608

(22) Filed: Jul. 16, 2021

(65) Prior Publication Data

US 2022/0072410 A1 Mar. 10, 2022

Related U.S. Application Data

(63) Continuation of application No. 16/366,781, filed on Mar. 27, 2019, now abandoned.

(60) Provisional application No. 62/681,267, filed on Jun. 6, 2018.

(51) Int. Cl.

| | |
|---|---|
| ***A63C 19/08*** | (2006.01) |
| ***A63B 63/00*** | (2006.01) |
| ***A63B 67/00*** | (2006.01) |
| ***E04H 17/18*** | (2006.01) |
| ***A63B 102/22*** | (2015.01) |

(52) U.S. Cl.

CPC ..... *A63C 19/08* (2013.01); *A63B 63/00* (2013.01); *A63B 67/002* (2013.01); *E04H 17/18* (2013.01); *A63B 2102/22* (2015.10); *A63B 2208/12* (2013.01); *A63B 2209/00* (2013.01); *A63B 2210/50* (2013.01); *A63B 2243/0025* (2013.01); *A63C 2019/085* (2013.01)

(58) Field of Classification Search

CPC ... A63C 19/08; A63C 2019/085; A63B 63/00; A63B 67/002; A63B 2102/22; A63B 2208/12; A63B 2209/00; A63B 2210/50; A63B 2243/0025; A63B 2225/093; A63B 71/022; A63B 71/023; A63B 1/00; E04H 17/18

See application file for complete search history.

(56) References Cited

U.S. PATENT DOCUMENTS 5,076,546 A * 12/1991 Henry ..... A47D 13/066 5/99.1
7,601,069 B2 * 10/2009 Freres ..... A63H 33/32 446/108
D652,462 S * 1/2012 Sun ..... D21/300

(Continued)

FOREIGN PATENT DOCUMENTS

GB 2466876 A * 7/2010 ..... E01F 13/022

*Primary Examiner* — Jeffrey S Vanderveen
(74) *Attorney, Agent, or Firm* — Erickson Law Group, PC

(57) ABSTRACT

A method of assembling a portable fenced-in ball playing area that includes a plurality of panels that have an upward slot on one end of the panel and a downward slot at the other end of the panel. The panels are assembled into a polygon shaped pit, such as for a Ga-ga pit, by fitment of upward and downward slots on adjacent panels. No tools are necessary for assembly. The panels can include hand holes for easy carrying. Some panels may have a top indentation or recess to assist children in entering or leaving the fenced-in ball playing area, such as a Ga-ga pit. These panels can be reversed so that the recess is facing downward to form a goal opening for a game using a ball, puck or the like.

6 Claims, 5 Drawing Sheets

(56) References Cited

U.S. PATENT DOCUMENTS

| | | | | |
|---|---|---|---|---|
| 8,506,370 | B2 * | 8/2013 | Homsi | A63B 24/0084 463/2 |
| 9,556,605 | B2 * | 1/2017 | Elliott | E04B 1/541 |
| 2004/0178584 | A1 * | 9/2004 | Fairbanks | A63B 67/06 273/400 |
| 2013/0277633 | A1 * | 10/2013 | Goode | E06B 5/00 256/25 |
| 2016/0107056 | A1 * | 4/2016 | Piccolo | A63F 13/53 463/31 |

* cited by examiner

PORTABLE MULTI-USE BALL PIT

The application is a continuation of U.S. Ser. No. 16/366,781 filed, Mar. 27, 2019, which claims the benefit of U.S. Provisional Application Ser. No. 62/681,267, filed Jun. 6, 2018.

BACKGROUND

Fenced-in playing areas are known. Particularly, the game of "Ga-ga" utilizes a fenced-in playing area. Ga-ga is played with one ball with the goal of the players to strike each other with the ball within a fenced-in area or "Ga-ga pit." Players must dodge the ball by running or dodging or jumping. Players are eliminated if the ball strikes them on or below the knee. Two or more players can play the game simultaneously in the Ga-ga pit.

The Ga-ga pit is typically a polygonal fenced-in area such as an octagon or hexagon. The Ga-ga pit is configured with rigid flat walls about 2-3 feet tall and is set on a relatively hard playing surface, such as an asphalt playground surface, to allow the ball to bounce and ricochet off the hard playing surface and the walls.

US patent applications 2014/0332742 and 2015/0105185 and U.S. Pat. D62462 all describe Ga-ga Pits.

The present inventors have recognized that it would be desirable to provide a Ga-ga pit that could be used outdoors and easily erected indoors when outdoor play is prevented due to weather. The present inventors have recognized that while it is known to provide permanent Ga-ga pits outdoors in schoolyards, it would be desirable to provide a portable Ga-ga pit for use in the school gymnasium when the weather prevents outdoor play, particularly during school recess or during school gym class.

The present inventors have recognized that while it is known to provide permanent Ga-ga pits outdoors in schoolyards, it would be desirable to provide a portable Ga-ga pit that can be assembled quickly without fasteners or tools.

The present inventers have recognized that it would be desirable to provide a Ga-ga pit that allowed for both a small group of players and a large group of players. The present inventors have recognized that it would be desirable to provide a fenced ball playing area that was convertible to different games. The present inventors have recognized that it would be desirable to provide a fenced ball playing area that was lightweight and durable.

SUMMARY

An exemplary embodiment of the invention comprises a portable fenced-in ball playing area, especially for children, which comprises a plurality of panels that have an upward slot on one end of the panel and a downward slot at the other end of the panel.

The panels are assembled into a polygon shaped pit, such as for a Ga-ga pit, by fitment of upward and downward slots on adjacent panels. No tools are necessary for assembly. The panels can include hand holes for easy carrying. Some panels may have a top indentation or recess to assist children in entering or leaving the fenced-in ball playing area, such as a Ga-ga pit. These panels can be reversed so that the recess is facing downward to form a goal opening for a game using a ball, puck or the like.

The panels provide a flexible system for creating a fenced-in play area. Standard panels of only two types can be used to create a playing pit having high walls around the pit formed by a first type of panel and an occasional recessed entryway or a goal opening by using a second type of panel. The panels are lightweight and durable. The panels allow for assembly indoors or outdoors. The panels provide an easy way for school teachers to set up a play pit in the school gymnasium during inclement weather when outdoor play is prevented.

The panels also provide convenient access for wheelchairs and children with mobility limitations in that a panel can be removed easily without the need for tools, or can be left unsecured at one end to be able to easily slide or pivot open. This is advantageous for children who cannot climb over the panel for entrance even with the recess on one panel for access.

Numerous other advantages and features of the present invention will become readily apparent from the following detailed description of the invention and the embodiments thereof, from the claims and from the accompanying drawings.

DETAILED DESCRIPTION

Figure 1:
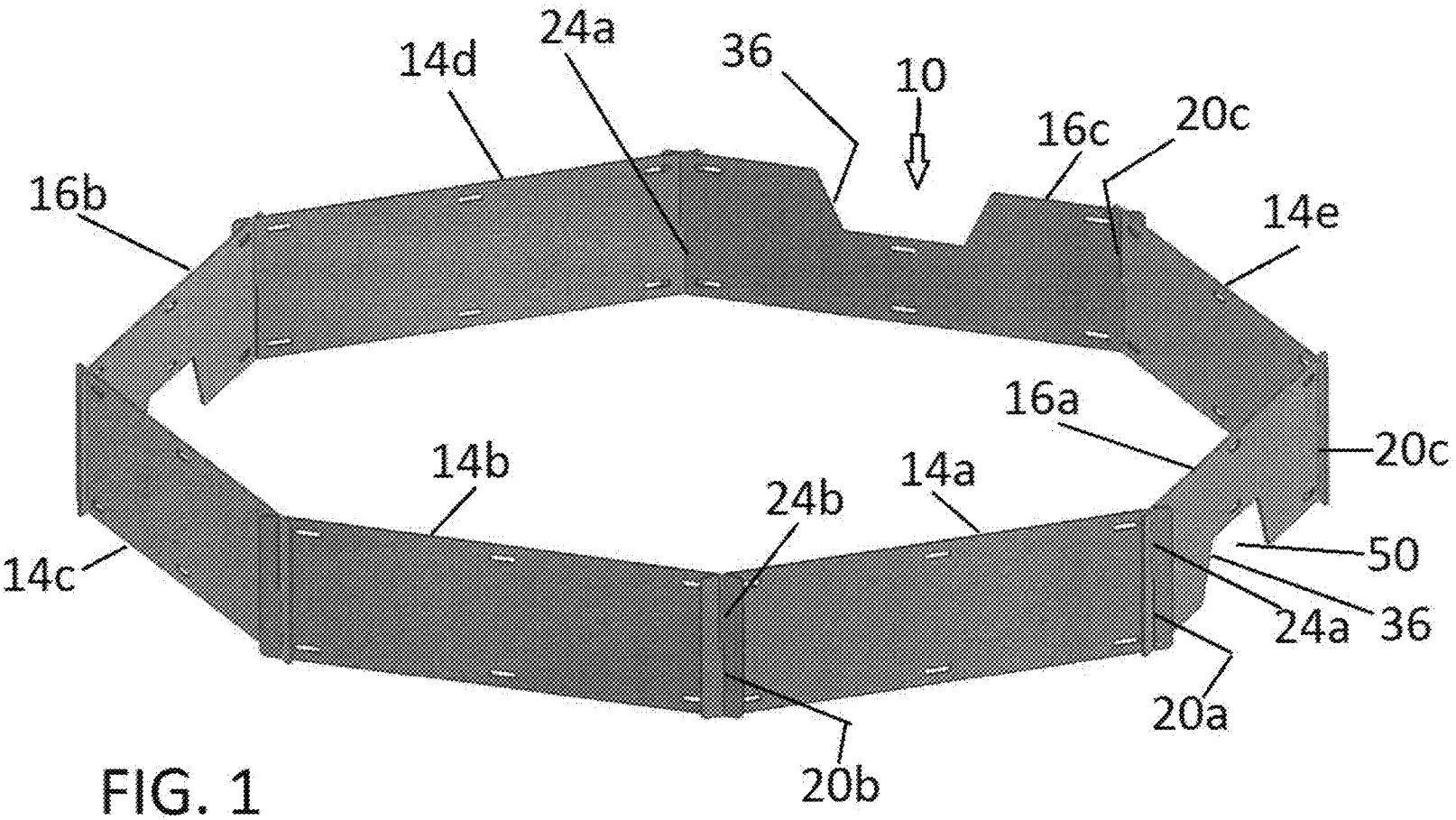
FIG. 1 is a perspective view of a fenced-in playing area according to the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

The application incorporates by reference in their entireties U.S. Provisional Application Ser. No. 62/681,267, filed Jun. 6, 2018 and U.S. Ser. No. 16/366,781 filed, Mar. 27, 2019.

Although the present specification is advantageously applied to the assembly of a Ga-ga pit, the invention encompasses any other type of game for which a fenced-in (or "walled-in") playing area is desired.

FIG. 1 shows a fenced-in playing area 10 that is formed with interlocking first panels 14*a*, 14*b*, 14*c*, 14*d* and interlocking second panels 16*a*, 16*b*, 16*c*. Each panel includes a downward open vertical slot adjacent one end of the panel and an upward open vertical slot adjacent an opposite end of the panel. Each slot has a length of about one half or more of the height of its panel. In order to interlock, the downward open vertical slot of one panel passes through the upward open vertical slot of an adjacent panel and fits over the adjacent panel. The upward open vertical slot simultaneously passes through the downward open vertical slot of the one panel and fits over the one panel.

As shown in FIG. 1, the foreground panel 14*a* includes a downward slot 20*a* and the adjacent panel 16*a* has an upward slot 24*a*. The panel 14*a* has been fit down onto the panel 16*a*. The downward slot 20*a* fits over the panel 16*a* and the upward slot 24*a* fits over the panel 14*a*. On an opposite end of the panel 14*a*, an adjacent panel 14*b* has been fit down onto the panel 14*a*. The adjacent panel 14*b* has a downward slot 20*b* that passes through an upward slot 24*b* of the panel 14*a* and fits over the panel 14*a*. Simultaneously, the upward slot 24*b* passes through the downward slot 20*b* and fits over the panel 14*b*. The interlocking of downward slots and upward slot is repeated at each joint between panels.

Figure 2:
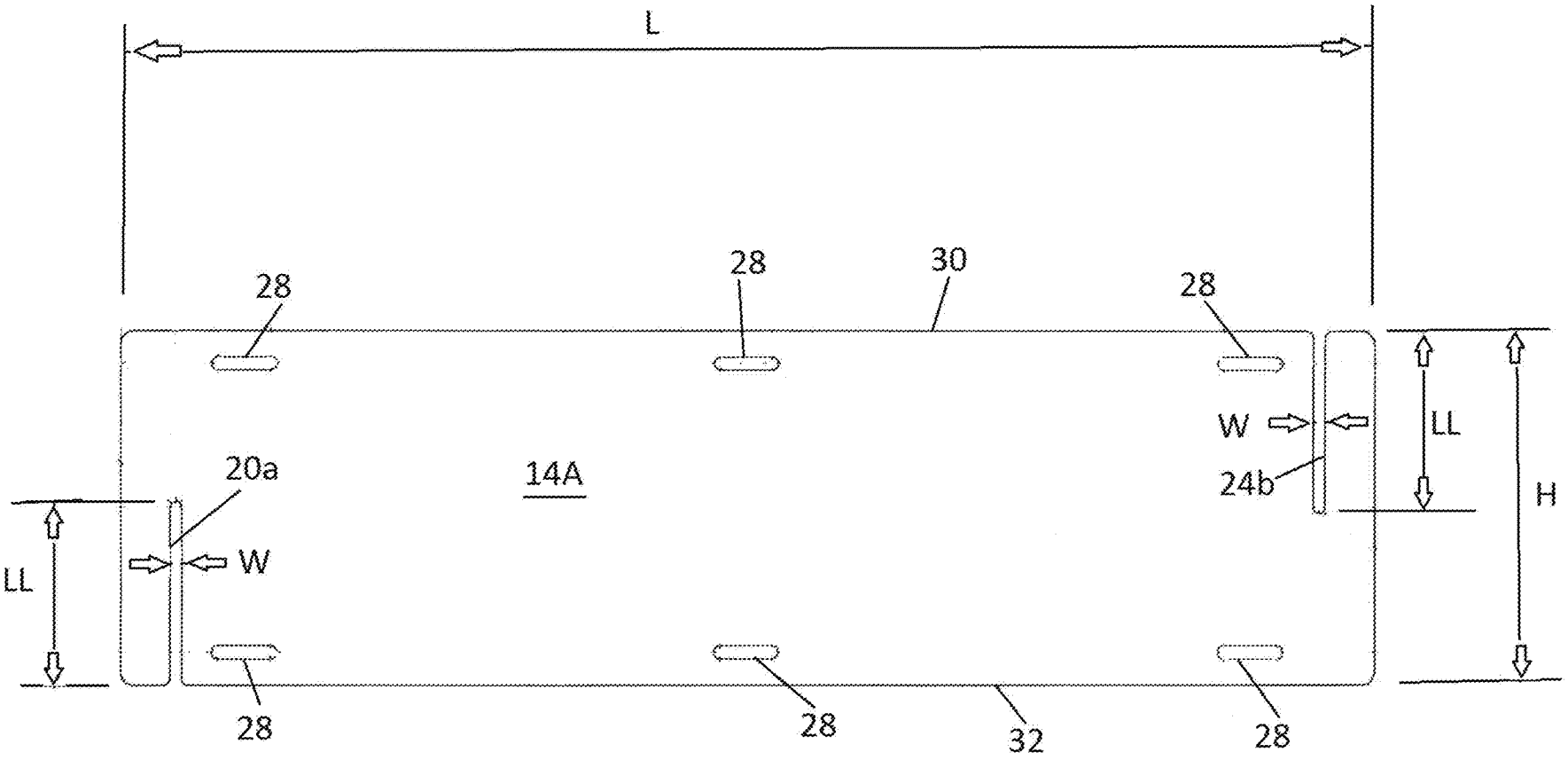
FIG. 2 is an elevation view of a first style panel used in the assembly of the fenced-in playing area shown in FIG. 1.

FIG. 2 illustrates the interlocking first panels 14*a*, 14*b*, 14*c*, 14*d*, 14*e*. The panel 14*a* is illustrated with the understanding that the panels 14*b*, 14*c*, 14*d*, 14*e* are identical. The panel 14*a* is substantially a rectangular plate having a length L of about 96 inches and a height H of about 27 inches. Adjacent one end is the downward open vertical slot 20*a*. Adjacent an opposite end is the upward open vertical slot 24*b*. The slots have a length LL in the height direction of about 14 inches. The slots have a width W of about 0.9 inches. The panel has a thickness of about ½ inch. Six hand holes 28 are arranged spaced apart, three adjacent to an upper edge 30 of the panel and three adjacent to a lower edge 32 of the panel. The hand holes are about 4 inches long and wide enough for the insertion of human fingers to lift and handle the panel. The panel can be rotated 180 degrees to where the upward open vertical slot 24*b* becomes a downward open vertical slot and the downward open vertical slot 20*a* becomes an upward open vertical slot. The hand holes 28 being along both the top and bottom edges facilitate lifting the panel no matter the orientation of the panel.

Figure 3:
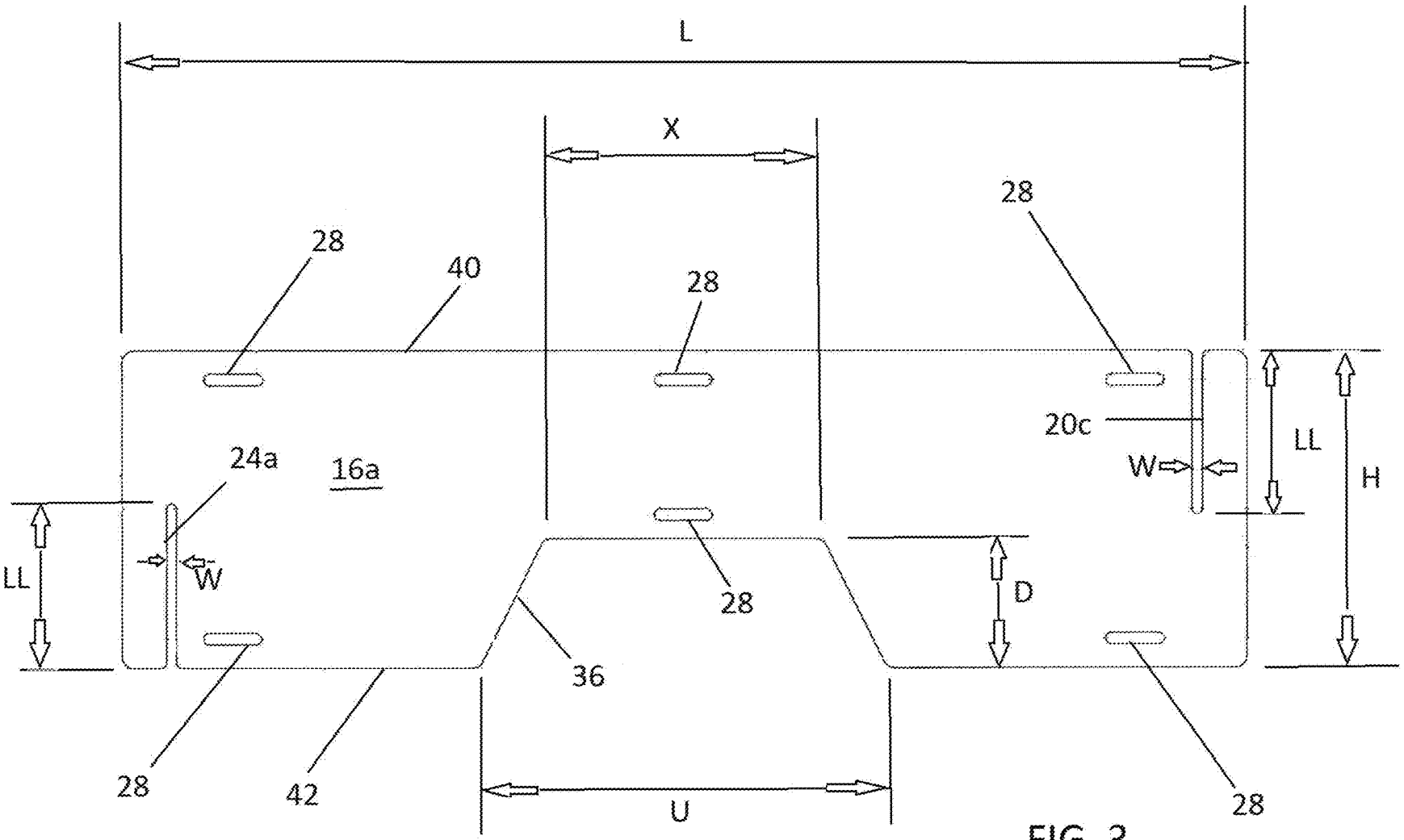
FIG. 3 is an elevation view of a second style panel used in the assembly of the fenced-in playing area shown in FIG. 1.

FIG. 3 illustrates the interlocking second panels 16*a*, 16*b*, 16*c*. The panel 16*a* is illustrated with the understanding that the panels 16*b*, 16*c* are identical. The panel 16*a* is substantially a rectangular plate having a length L of about 96 inches and a height H of about 27 inches. Adjacent one end is a downward open vertical slot 20*c*.

Adjacent an opposite end is the upward open vertical slot 24*a*. The slots have a length LL in the height direction of about 14 inches. The slots have a width W of about 0.9 inches. The panel 16*a* has a thickness of about ½ inch. The panel has an upper edge 40 and a lower edge 42.

A tapered recess 36, is indented from the lower edge 42. The recess 36 has a depth D of about 11 inches. It has a width U at the lower edge 42 of about 35 inches and a width X at a top of the recess of about 24 inches.

Six hand holes 28 are arranged spaced apart, two adjacent to the lower edge 42 of the panel 16*a*, adjacent opposite ends of the panel, and one just above the recess 36, and three adjacent to a upper edge 40 of the panel. The hand holes are about 4 inches long and wide enough for the insertion of human fingers to lift and handle the panel.

The panel 16*a* can be rotated 180 degrees to where the downward open vertical slot 24*a* becomes an upward open vertical slot and the upward slot 20*c* becomes a downward open vertical slot. The hand holes 28 being along both the top and bottom edges facilitate lifting the panel no matter the orientation of the panel. As shown in FIG. 3 the recess 36 is facing downward. In this orientation, the panel 16*a* provides a goal opening 50 (FIG. 1) for a game within the fenced-in area where an object of the game is to pass a ball or puck or the like through the goal opening 50, similar to hockey or soccer.

When the panel 16*a* is rotated 180 degrees about the horizontal axis, it takes on the orientation of panel 16*c* (FIG. 1) where the recess 36 functions as a lowered entry into the fenced-in area, especially for smaller children who would not be able to step over the full height of the panel.

The panels 14*a*, 14*b*, 14*c*, 14*d*, 14*e*, 16*a*, 16*b*, 16*c* are advantageously composed of high density polyethylene for durability and a light weight.

As can be understood, the interlocking first panels and the interlocking second panels can be selected to form a preselected fenced-in area. By using all interlocking first panels 14*a*, 14*b*, etc., and one interlocking second panel 16*c* in the orientation of panel 16*c*, when the panels are interlocked using the downward and upward slots, a substantially solid fenced-in area with a lowered entryway can be provided. The number of panels can be selected to form a square, a triangle, a hexagon and octagon or other polygon shapes.

By using interlocking first panels 14*a*, 14*b*, etc., and one or more interlocking second panel 16*a* in the orientation of panel 16*a* in FIG. 1, when the panels are interlocked using the downward and upward open vertical slots, a substantially solid fenced-in area with one or more goal openings 50 can be provided. An additional panel 16*c*, in the orientation of panel 16*c* in FIG. 1, can also be provided for a lowered entryway. The number of panels can be selected to form a square, a triangle, a hexagon and octagon or other polygon shapes.

Figure 4:
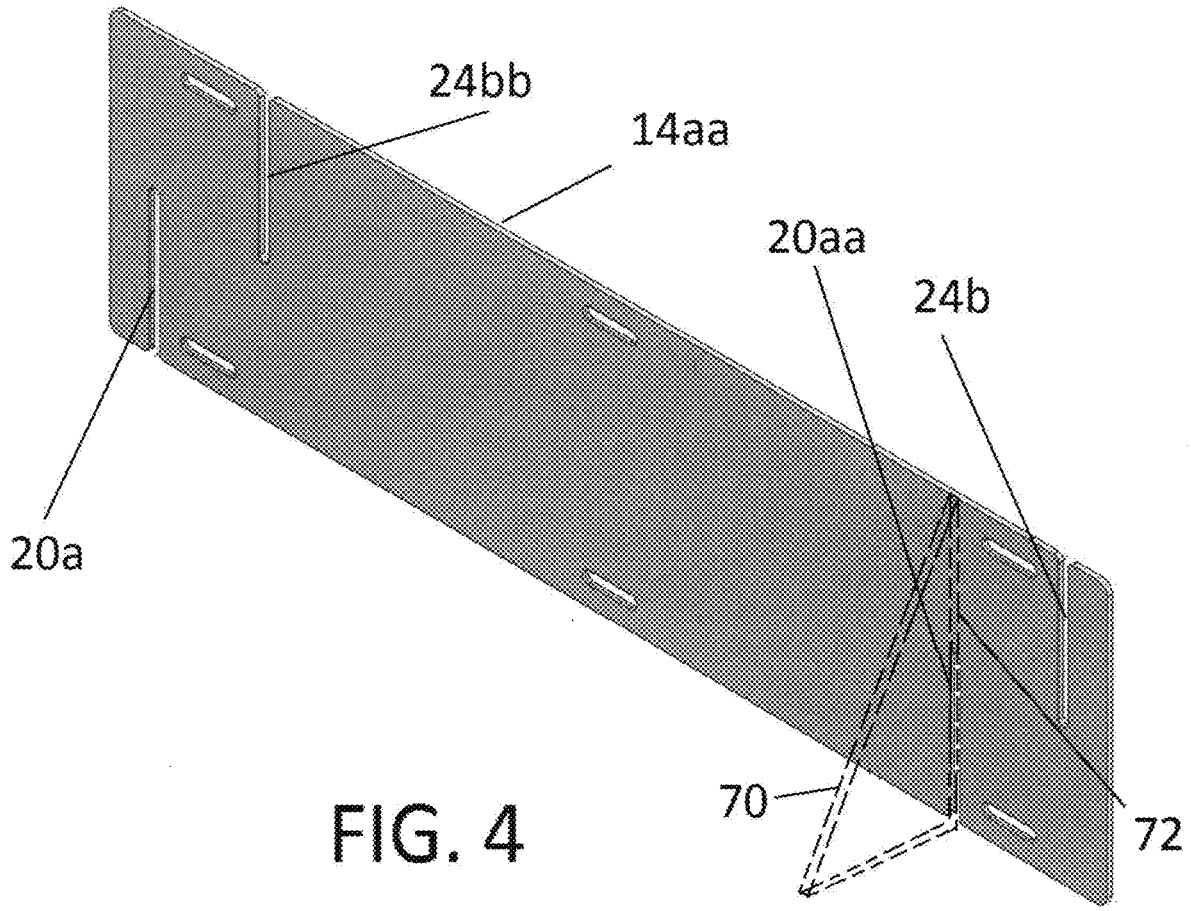
FIG. 4 is a perspective view of an alternate first style panel.

FIG. 4 shows an alternate embodiment of the first type panel 14*aa* which can replace one or more or all of the panels 14*a*, 14*b*, 14*c*, 14*d*, 14*e* shown in FIG. 1. This panel is identical to the first panel 14*a* and like panels except an additional downward open vertical slot 20*aa* and an additional upward open vertical slot 24*bb* are added. These slots have substantially the same dimensions as the slots 20*a*, 24*b*. The slots 20*aa*, 24*bb* are located along the length of the panel between the slots 20*a*, 24*b*.

Figure 5:
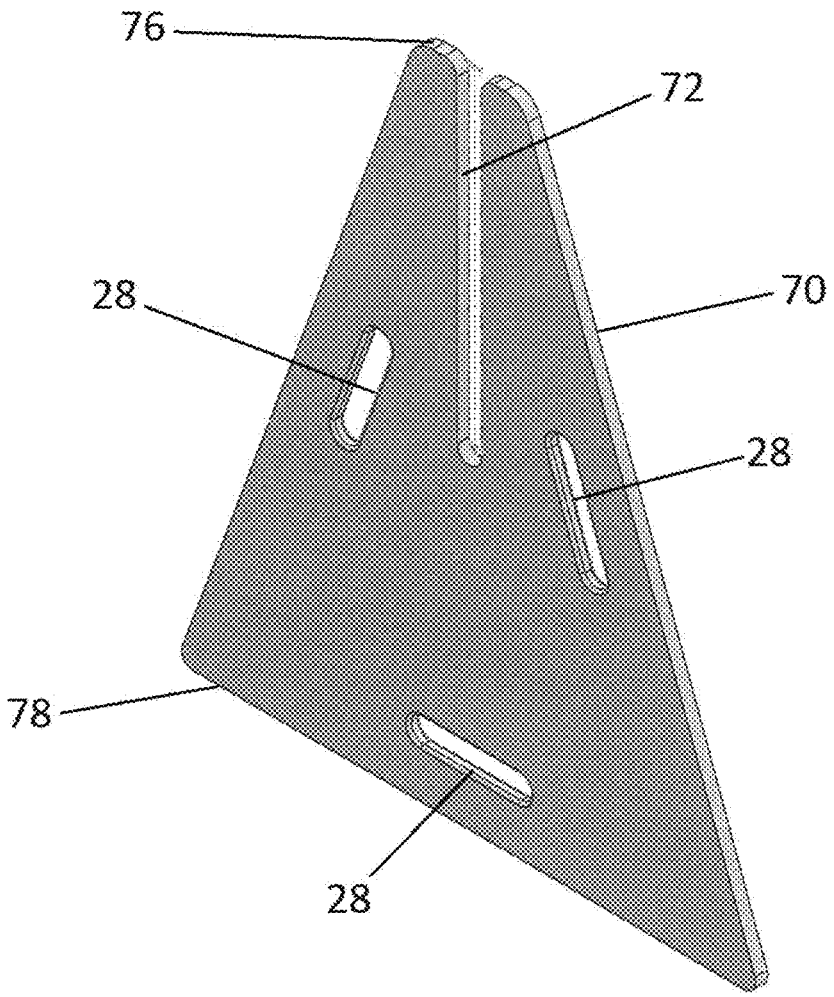
FIG. 5 is a perspective view of a panel stand.

The addition of these slots adds more flexibility to the interlocking of the panels by allowing for a shorter panel (horizontally) by using the inside slots 20*aa*, 24*bb* and also allows for the use of the stand 70 as shown in FIG. 5. Additionally, the panels 16*a*, 16*b*, 16*c* and like panels can also have the two additional slots, one upward open vertical slot and one downward open vertical slot, between the slots 24*a*, 20*c*.

FIG. 5 illustrates a stand 70. The stand 70 includes three spaced apart hand holes 28, and an upward facing vertical slot 72 of about ½ the height of the stand. The stand has a triangular shape with a narrow top edge 76 and a wider bottom edge 78.

Other shapes for the stand are encompassed by the invention. The stand 70 is shown dashed in FIG. 4. As shown in FIG. 4, the upward facing vertical slot 72 of the stand and the downward facing vertical slot 20*aa* of the panel mutually interlock. The stand bottom edge rests on the ground and supports the panel 14*aa*. The stand could just as well be mutually interlocked with the slot 20*a* of the panel 14*aa* or any other panel shown in FIG. 1. The stands allow for one or both ends of a panel, even if that end is not interlocked with an adjacent panel, to be nonetheless supported in a vertical orientation. A stand can be of a lesser height than the panel supported by the stand is also encompassed by the invention.

The stands 70 provide opportunity to convert the traditional octagonal pit design into individual free standing entities. The individual panels can then be utilized for other games and sports. The stands allow easy transformation into a variety of shapes other than for Ga-ga Ball. The stands allow panels to be used as independent units or connected in a linear design. A long barrier can be created or can be used to form 90° angles.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A method for assembling an octagonal Ga-ga pit, comprising;

providing a plurality of panels, the panels having a height of between 2 and 3 feet, each panel having a thickness and an upward open slot adjacent to one end and a downward open slot adjacent an opposite end;

the slots having a length of at least have the height of its respective panel, the slots having a width greater than an adjacent panel thickness;

each panel having a plurality of hand holes spaced-apart adjacent one elongated edge, each hand hole wide enough for the insertion of human fingers to lift each panel for assembling the Ga-ga pit;

and engaging the panels end-to-end to form an octagonal-shaped Ga-ga pit.

2. The method according to claim 1, wherein at least one of the panels includes a recess from one edge of the panel to provide a lowered entry location for a player to enter the playing area.

3. The method according to claim 1, wherein at least one of the panels forms a goal opening.

4. The method according to claim 1, wherein at least one of the panels includes a recess from one edge of the panel to provide either a lowered entry location for a player to enter the playing area when set in one orientation or a goal opening when set in an alternate orientation.

5. The method according to claim 1, wherein at least one of the panels includes a recess from one edge of the panel to provide either a lowered entry location for a player to enter the playing area when set in one orientation or a goal opening when set in an alternate orientation.

6. The method according to claim 1, wherein at least one of the panels includes a recess from one edge of the panel to provide either a lowered entry location for a player to enter the playing area when set in one orientation or a goal opening when set in an alternate orientation.

* * * * *